US007191993B2

(12) United States Patent
Bobrowski

(10) Patent No.: US 7,191,993 B2
(45) Date of Patent: Mar. 20, 2007

(54) APPARATUS AND METHOD FOR INSTALLATION OF RECESSED LIGHTING FIXTURE

(75) Inventor: Christopher T. Bobrowski, Wheeling, IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 84 days.

(21) Appl. No.: 11/024,884

(22) Filed: Dec. 29, 2004

(65) Prior Publication Data

US 2005/0141818 A1 Jun. 30, 2005

Related U.S. Application Data

(60) Provisional application No. 60/533,356, filed on Dec. 30, 2003.

(51) Int. Cl.
*A47H 1/00* (2006.01)

(52) U.S. Cl. ..... 248/318; 248/906; 362/147; 385/78

(58) Field of Classification Search ..... 248/318, 248/320, 327, 329, 906; 439/607; 362/150, 362/365, 147, 364, 391, 403; 385/78
See application file for complete search history.

(56) References Cited

U.S. PATENT DOCUMENTS

| | | | | |
|---|---|---|---|---|
| 3,912,865 | A * | 10/1975 | Seebinger | 381/124 |
| 4,673,149 | A * | 6/1987 | Grote et al. | 248/343 |
| 4,999,757 | A * | 3/1991 | Poppenheimer | 362/287 |
| 5,440,471 | A * | 8/1995 | Zadeh | 362/365 |
| 6,004,011 | A * | 12/1999 | Sieczkowski | 362/365 |
| 6,095,669 | A * | 8/2000 | Cho | 362/365 |
| 6,343,873 | B1 * | 2/2002 | Eberhard et al. | 362/364 |
| 6,505,960 | B2 * | 1/2003 | Schubert et al. | 362/365 |
| 6,991,352 | B2 * | 1/2006 | Garber et al. | 362/396 |
| 2003/0210551 | A1 * | 11/2003 | Sevack et al. | 362/365 |
| 2003/0223240 | A1 * | 12/2003 | Houle | 362/364 |
| 2004/0027832 | A1 * | 2/2004 | Hyder | 362/365 |

* cited by examiner

*Primary Examiner*—Ramon O Ramirez
(74) *Attorney, Agent, or Firm*—Sonnenschein Nath & Rosenthal LLP

(57) ABSTRACT

A lighting apparatus for installation through a hole in a ceiling is disclosed. The lighting apparatus has a housing, a frame designed to rest on the upper surface of the ceiling and at least one retention cable secured to the frame that passes through the opening in the frame and the hole in the ceiling to temporarily retain the frame against the upper surface of the ceiling while sliding the lamp housing through the ceiling and the opening in the frame. A method for installing a lighting fixture is also disclosed.

19 Claims, 5 Drawing Sheets

APPARATUS AND METHOD FOR INSTALLATION OF RECESSED LIGHTING FIXTURE

CROSS REFERENCE TO RELATED APPLICATIONS

This application claims benefit of U.S. Provisional Ser. No. 60/533,356 filed on Dec. 30, 2003 entitled "APPARATUS AND METHOD FOR INSTALLATION OF RECESSED LIGHTING FIXTURE."

BACKGROUND OF THE INVENTION

Recessed lighting fixtures are typically installed in the space above an existing ceiling substrate—i.e., drywall, plaster, wood, planking, etc. The lighting fixtures may be installed either before or after the installation of the ceiling. When recessed lighting fixtures are installed after the installation of the ceiling, a specified diameter hole typically needs to be cut into the ceiling substrate. The housing for the lighting fixture is then inserted into the hole from below the ceiling line and locked into position within the hole by some mechanical means. Conventionally, this mechanical retention is usually performed by a mounting clip or spring that extends from the housing. The spring or clip is designed to trap the ceiling substrate material between a circumferential ring on the housing at the ceiling line and the "top side" of the substrate. The mechanical fasteners (i.e., spring or clip type devices) are typically engaged by pushing and locking into position in the housing sidewall or tightening a screw or fastener to lock the clip or spring into position in the housing sidewall.

However, in many remodeling applications, installation using conventional spring and clips may not be feasible due to space limitations imposed by the housing, socket, socket brackets, or other parts required in conventional recessed lighting fixtures. Accordingly, there is a need in the industry for a fixture that overcomes this limitation of conventional fixture, among others.

SUMMARY OF THE INVENTION

The present invention is a lighting apparatus comprising a housing, a frame having an opening of a sufficient size to receive the housing, and two retention cables, each having a first end and a second end. The housing includes two apertures in a wall of the housing to allow the second end of the retention cable to be passed through the wall. In one embodiment, the two apertures in the wall of the housing are elongated slots extending vertically along the sidewall. Preferably, the elongated slots are located on opposing portions of the sidewall.

In one aspect of the invention, the first end of each retention cable is attached to the frame. The first and second retention cables also preferably include means for connecting the second end of the first retention cable to the second end of the second retention cable. In one embodiment, the means for connecting include a first hook attached to the second end of the first retention cable and a second hook attached to the second end of the second retention cable.

In another aspect, the present invention includes a method of installing a lighting fixture comprising the steps of inserting a frame through a hole in a ceiling, pulling down on at least one retention cable to retain the frame against the upper surface of the ceiling, and sliding the housing through the opening in the frame while pulling down on the at least one retention cable;

DETAILED DESCRIPTION OF THE INVENTION

Figure 1:
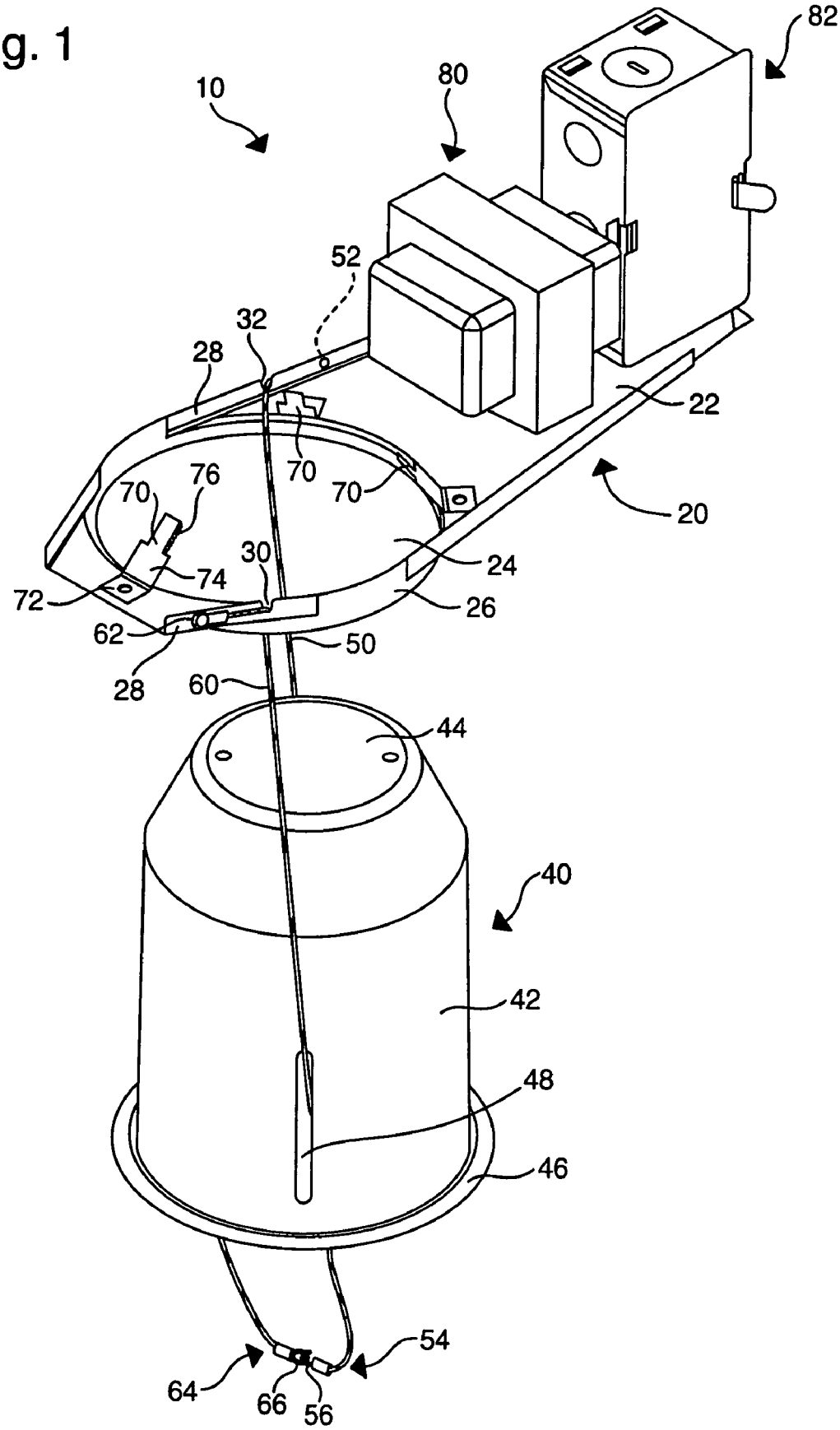
FIG. 1 shows one embodiment of the present invention prior to insertion of the housing into the frame.
Figure 2:
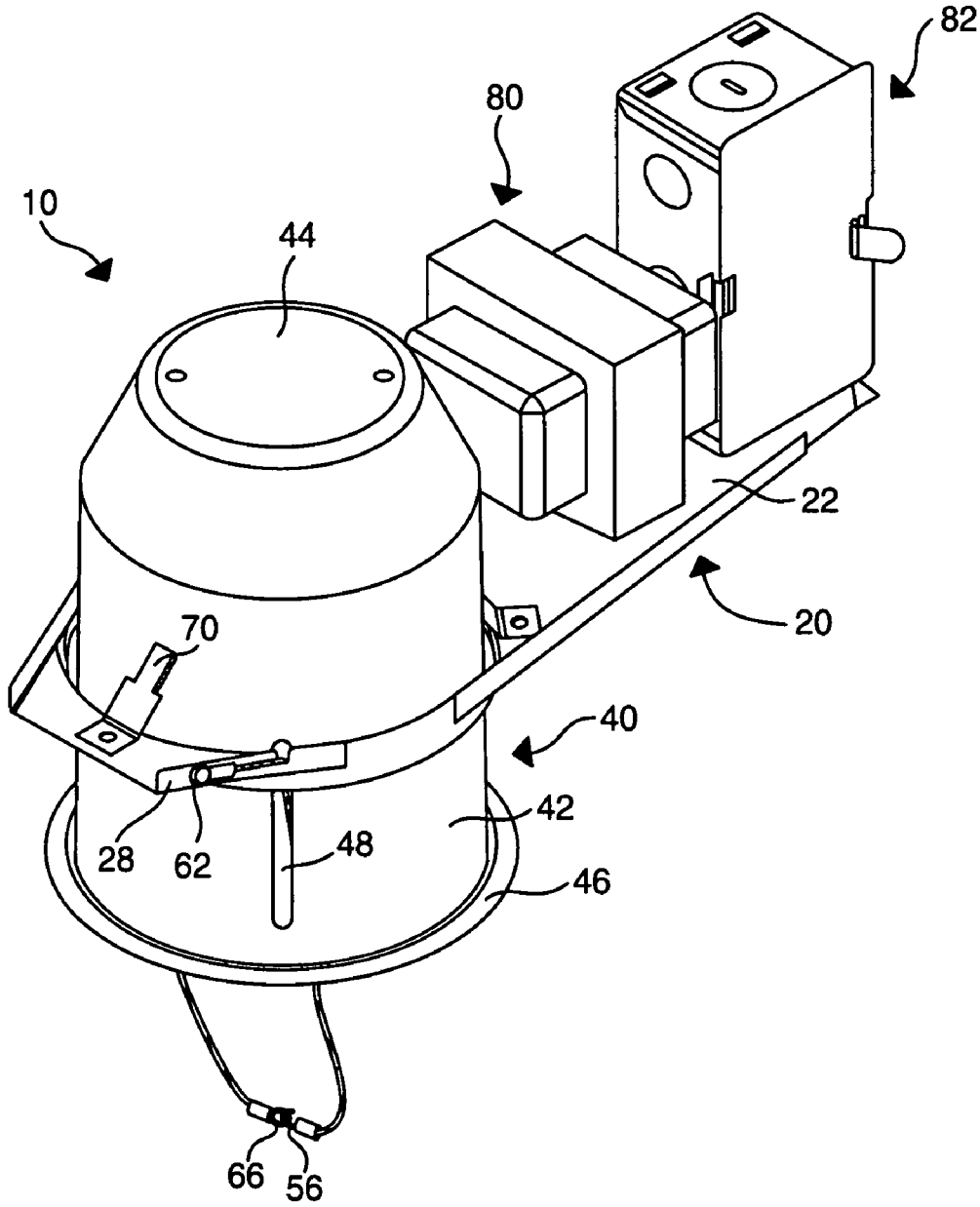
FIG. 2 shows one embodiment of the present invention with the housing partially inserted into the frame.
Figure 3:
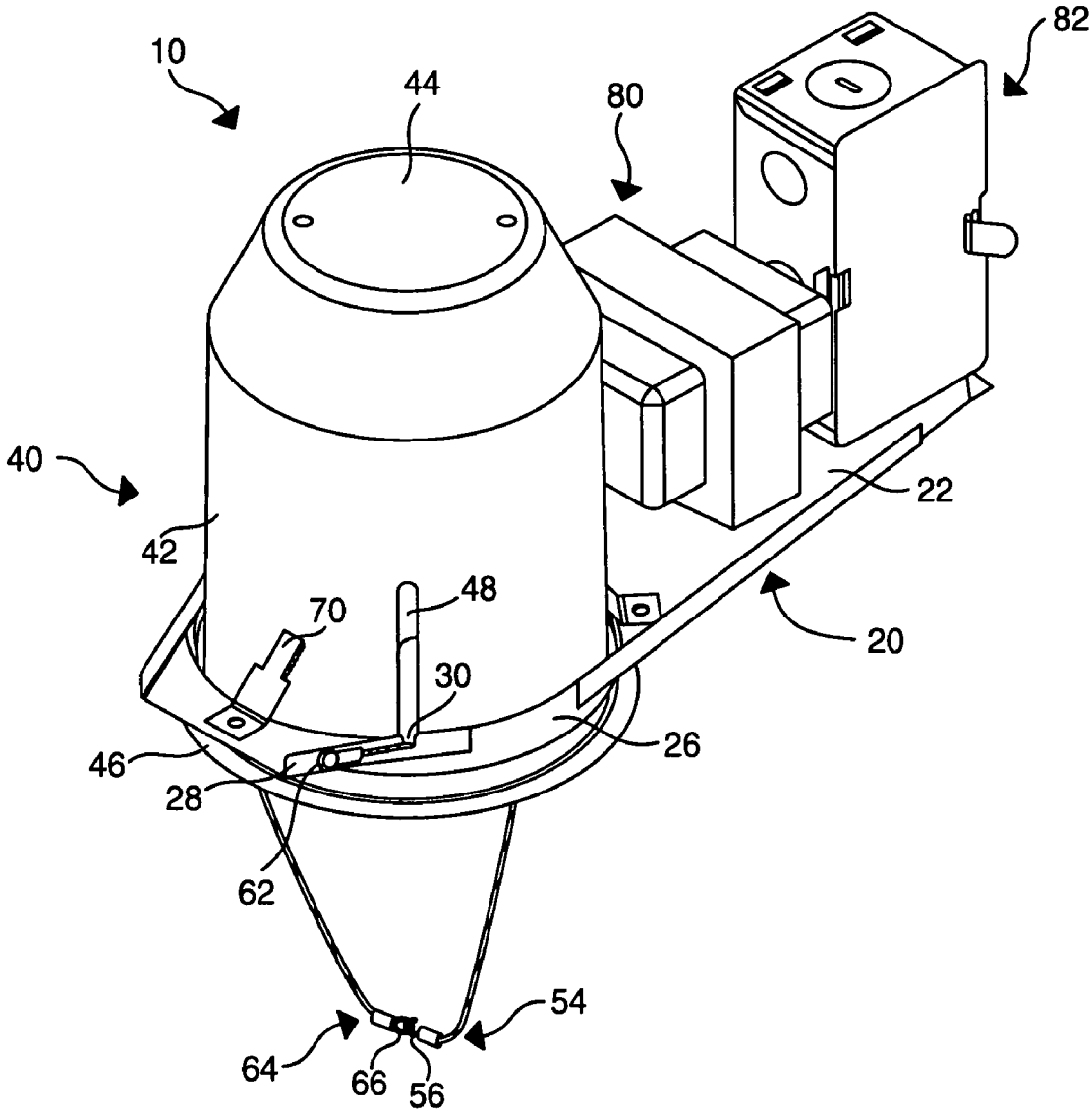
FIG. 3 shows one embodiment of the present invention with the housing fully inserted into the frame.

FIGS. 1 through 3 show one embodiment of a recessed lighting fixture 10 according to the present invention. The lighting fixture 10 includes a frame 20, a housing 40, and two retention cables 50 and 60.

The frame includes a flat base 22 designed to rest on the top of an upper surface of a ceiling. The frame also includes a circular opening 24 having a sufficient diameter to receive the housing 40 and a downwardly directed lip 26 extending from the perimeter of the opening 24. The frame may also include an upwardly extending flange 28 positioned along portions the exterior perimeter of the frame. Two notches 30 and 32 may be located along the upwardly extending flange 28 on opposite sides of the opening 24 for guiding the retention cables 50 and 60, respectively.

As shown in FIGS. 1 through 3, the frame 20 may also be configured to allow mounting of a transformer 80 and/or a junction box 82 onto the frame. A cable 84 (see FIGS. 4 and 5) may be connected between the junction box and the housing in order to provide power to a lamp (not shown) inserted into a light socket in the housing.

The housing 40 preferably has a circular sidewall 42 and an flat upper wall 44. The bottom portion of the housing is typically open to receive a light socket and a lamp, and may also include a flange 46 extending around the outer circumference of the bottom of the sidewall 42. Although the housing is shown as being cylindrical, the housing can be of any shape so long as the housing is capable of being received through the opening in the frame. For example, the housing 40 and the opening 24 may be oval, rectangular, elliptical, triangular, or any other shape.

The housing 40 also preferably includes two apertures 48 in the sidewall 42 to allow the retention cables to be passed through the sidewall of the housing 40. In one embodiment shown in FIGS. 1 and 2, the apertures are elongated slots extending vertically along the sidewall, and located on opposite sides of the sidewall from one another. The apertures may be any shape so long as the retention cables 50 and 60 are capable of being passed through the aperture.

Each of the two retention cables 50 and 60 has a first end 52, 62 and a second end 54, 64 respectively. The first end of each retention cable is preferably secured to exterior side of the upwardly extending flange 28 along the perimeter of the frame. In one embodiment, the first end of each cable is secured by forming a loop of cable at the first end and inserting a screw, having a head larger than the diameter of the loop, through the loop of cable and into the frame. Of course, the retention cables may also alternatively be secured to the flat base 22 of the frame 20. Various methods for securing or fastening the cable to the frame may be used without departing from the invention.

Preferably, the second end of each retention cable includes means for selectively connecting to the second end of the opposing retention cable. In one embodiment, the second end of each retention cable 50 and 60 includes a hook 56 and 66, respectively, to allow each cable to be connected or "hooked" to one another. Alternatively, the first retention cable may include a hook while the second cable may simply includes a ring. In addition, any other means may be used for connecting the first and second retention cables so long as it is sufficient to maintain connection between the first and second retention cables while a user is pulling down on the retention cables.

In one embodiment of the present invention, the retention cables 50 and 60 are preferably constructed of flexible wire. Of course, any material may be used so long as it has sufficient tensile strength to permit the user to retain the frame 20 against the ceiling while inserting the housing 40 through the opening 12 in the frame 20. Additionally, while the retention cables 50 and 60 are shown as being flexible, the retention cables may also be constructed from a rigid material, or a combination of rigid and flexible sections.

A plurality of tension springs 70 may also be attached to the top surface of the frame in proximity to the opening 24. Each tension spring 70 preferably includes a base 72 attached to the frame 20 and an upper portion 74 extending upwards from the frame and into the interior of the aperture 24. When the housing 40 is inserted into the frame, the tension springs 70 maintain friction against the sidewall of the housing to aid in retaining the housing in place after installation. In one embodiment, the upper portion of the tension springs includes a set of jagged teeth 76 to increase the friction of the tension springs against the housing. It should be understood that while FIG. 1 shows three tension springs attached to the frame, any number of springs may be used. Additionally, while the present embodiment is illustrated using one specific type of spring, any other types of springs, clips, or other well-known mechanisms may alternatively be used for retaining the housing 40 after it is inserted into the frame 20.

Figure 4:
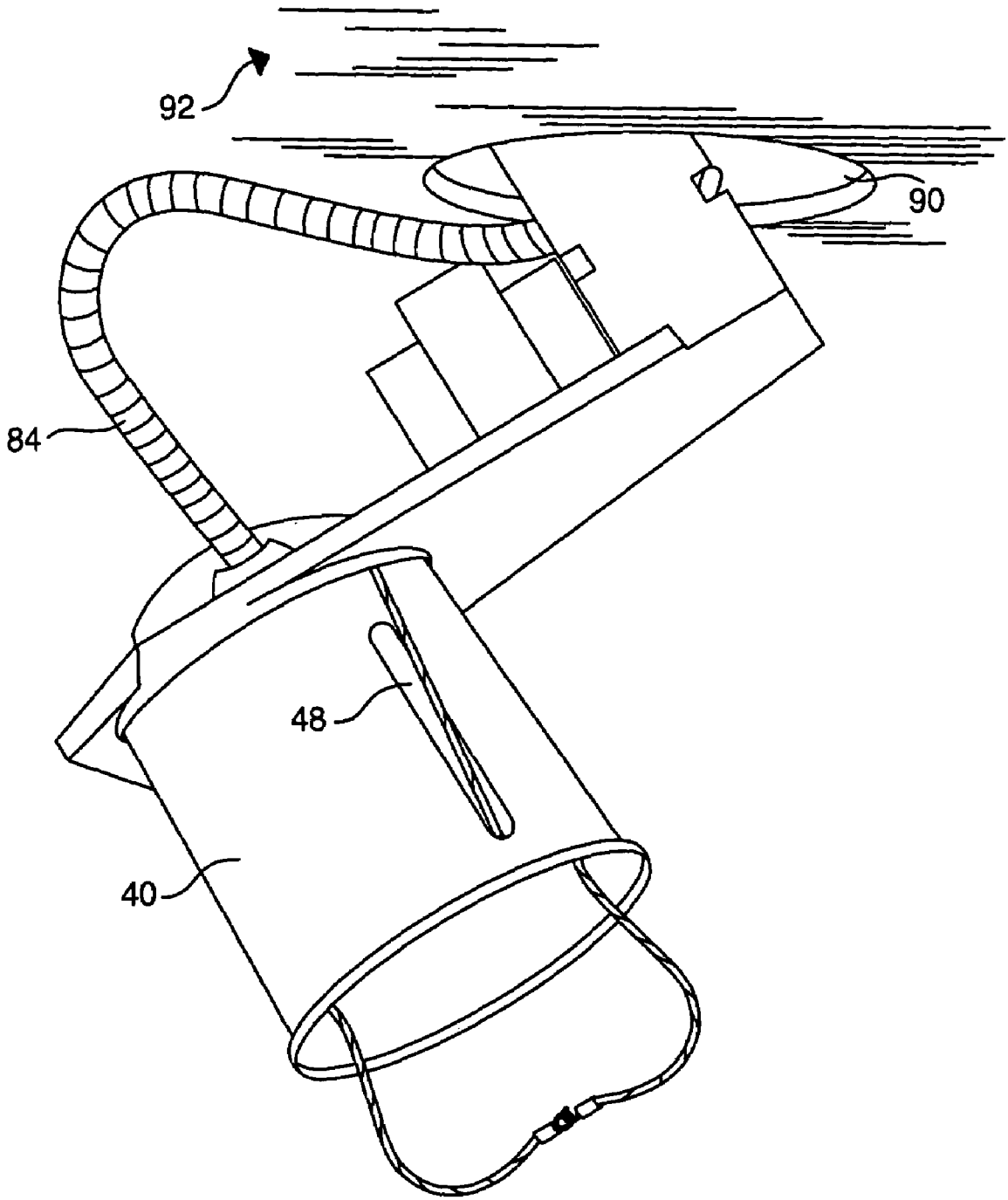
FIG. 4 shows one embodiment of the present invention being inserted into a ceiling.
Figure 5:
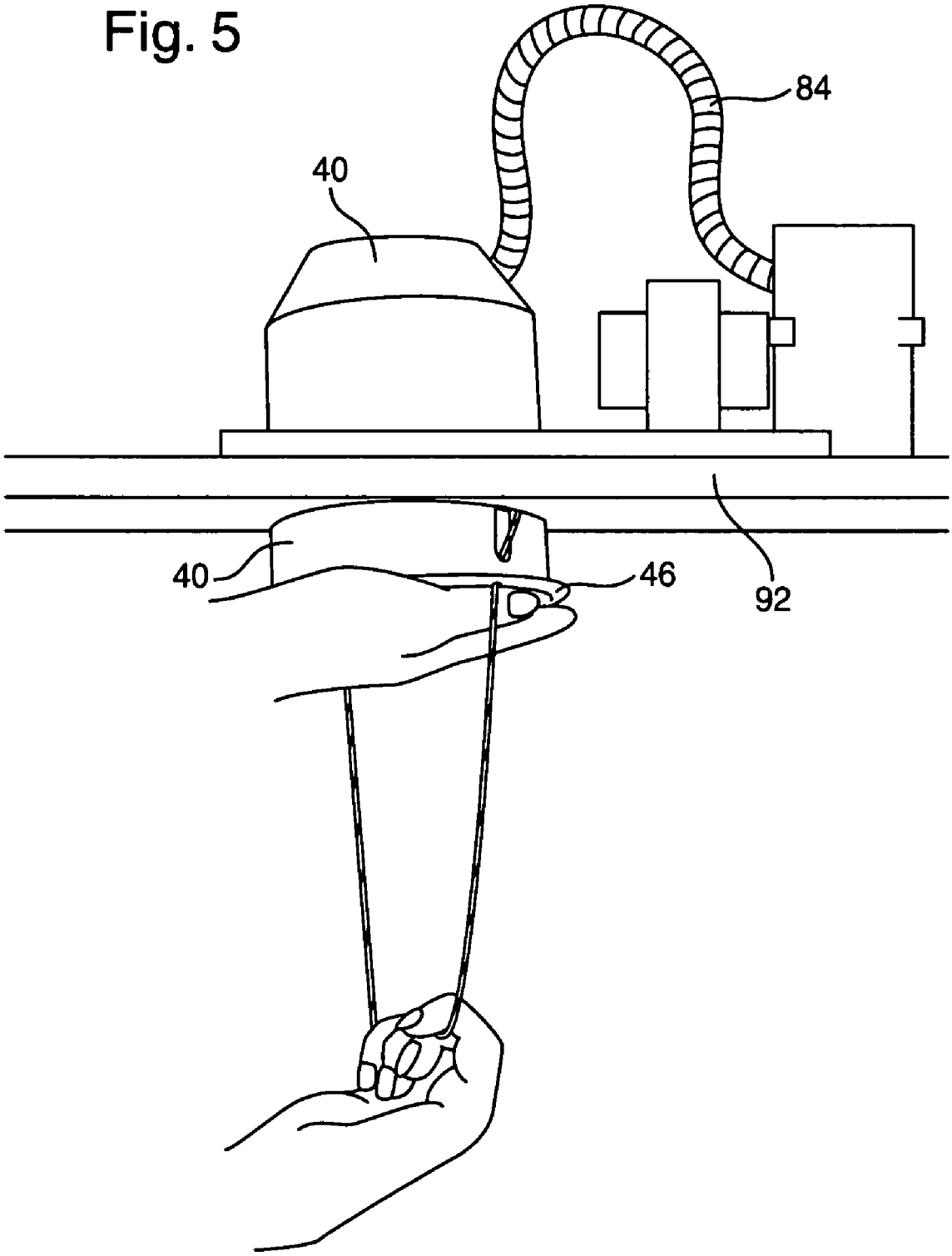
FIG. 5 illustrates one method of installing the present invention.

As shown in FIG. 4, in order to install the above described lighting fixture, a hole 90 is first cut into a ceiling 92. The size and shape of the hole 90 is preferably similar in diameter to that of the aperture 24. In one embodiment, a template may be provided with the lighting fixture in order to aid in measuring the proper size of the hole. The second end of each retention cable is passed from the exterior of the housing 40 through the elongated slots 48 in the sidewall and into the interior of the housing. The retention cables are then connected to one another by hooking the second end of one retention cable onto the other.

The frame is then inserted through the hole 90 that has been cut in the ceiling and is positioned above the hole so that the opening in the frame is aligned with the hole. As then illustrated in FIG. 5, upon seating the frame onto the ceiling, an installer holds and pulls downward on the retention cables to hold the frame in place against the ceiling. At the same time, the housing is 40 inserted into the opening 24 of the frame by firmly pushing the housing upwards until the flange 46 of the housing rests against the lower surface of the ceiling, at which time the housing becomes secured by the tension springs. Once the housing is secured flush with the ceiling, the retention cables are separated from one another and pushed back into the ceiling cavity through the elongated slots in the housing sidewall.

While various embodiments of the application have been described, it will be apparent to those of ordinary skill in the art that many more embodiments and implementations are possible that are within the scope of this invention. Accordingly, the invention is not to be restricted except in light of the attached claims and their equivalent.

What is claimed is:

1. A lighting apparatus for installation through a hole in a ceiling, the ceiling having an upper surface and an exposed lower surface, the lighting apparatus comprising:

a housing;

a frame designed to rest on the upper surface of the ceiling, the frame having a top surface and an opening to receive the housing; and a first retention cable secured to the frame and passing through the opening in the frame and the hole in the ceiling;

wherein the housing includes a first aperture in a wall of the housing to allow the first retention cable to be passed through the wall.

2. The lighting apparatus of claim 1 further including a transformer and a junction box mounted on the top surface of the frame.

3. The lighting apparatus of claim 1 further including a second retention cable secured to the frame and passing through the opening in the frame, the hole in the ceiling and the first aperture.

4. The lighting apparatus of claim 1 wherein the housing includes a second aperture in the wall of the housing, the second aperture being spaced-apart from the first aperture, the lighting apparatus further including a second retention cable secured to the frame and passing through the opening in the frame, the hole in the ceiling and the second aperture.

5. The lighting apparatus of claim 4 wherein the first and second apertures are located on substantially opposing portions of the wall.

6. The lighting apparatus of claim 5 wherein the first and second apertures are first and second elongated slots in the wall of the housing, each of the first and second elongated slots extending along the wall.

7. The lighting apparatus of claim 6 wherein the wall is the side wall of the housing.

8. The lighting apparatus of claim 7 wherein the first retention cable and the second retention cables are selectively attached to each other.

9. The lighting apparatus of claim 8 wherein each of the first and the second retention cables have a connector that mates one with the other.

10. The lighting apparatus of claim 1 further including a second retention cable secured to the frame and passing through the opening in the frame and the hole in the ceiling.

11. The lighting apparatus of claim 1 wherein the first retention cable is secured to the top surface of the frame.

12. A lighting apparatus for installation through a hole in a ceiling, the ceiling having an upper surface and an exposed lower surface, the lighting apparatus comprising:

a housing;

a frame designed to rest on the upper surface of the ceiling, the frame having a top surface and an opening to receive the housing; and a first retention cable secured to the frame and passing through the opening in the frame and the hole in the ceiling;

wherein the frame includes an upwardly extending flange extending from the top surface of the frame, and the first retention cable is secured to the upwardly extending flange.

13. A lighting apparatus for installation through a hole in a ceiling, the ceiling having an upper surface and an exposed lower surface, the lighting apparatus comprising:

a housing;

a frame designed to rest on the upper surface of the ceiling, the frame having a top surface and an opening to receive the housing;

a first retention cable secured to the frame and passing through the opening in the frame and the hole in the ceiling; and at least one tension spring attached to the top surface of the frame proximate the opening, the at least one tension spring constructed to substantially retain the housing when the housing is inserted through the opening in the frame.

14. A lighting apparatus for installation through a hole in a ceiling, the ceiling having an upper surface and an exposed lower surface, the lighting apparatus comprising:

a lamp housing;

a frame designed to rest on the upper surface of the ceiling, the frame having an opening to receive the lamp housing; and means for temporarily retaining the frame against the upper surface of the ceiling in alignment with the hole in the ceiling while sliding the lamp housing through the opening in the frame.

15. A method of installing a lighting fixture through a hole in a ceiling, the lighting fixture having a frame with an opening that receives a lamp housing, the method comprising:

inserting the frame through the hole in the ceiling;

resting the frame on an upper surface of the ceiling such that the frame opening is substantially aligned with the hole in the ceiling;

pulling down on at least one retention cable that is secured to the frame to retain the frame against the upper surface of the ceiling; and sliding the lamp housing through the frame opening while pulling down on the at least one retention cable.

16. The method of claim 15 wherein the lamp housing has a first aperture in a wall of the lamp housing the method further including passing the at least one retention cable through the first aperture.

17. The method of claim 16 wherein the lamp housing has a second aperture in the wall of the lamp housing spaced-apart from the first aperture and the at least one retention cable includes a first and a second retention cable, the method further including:

passing the first retention cable through the first aperture and second retention cable through the second aperture;

connecting the first and second retention cables together; and pulling down on the first and second retention cables together.

18. The method of claim 17 further including:

separating, once the housing is inserted through the opening in the frame, the first retention cable from the second retention cable; and passing the first and second retention cables back through the apertures in the lamp housing such that the first and second retention cables are located exterior to the lamp housing.

19. The method of claim 15 further comprising hiding the at least one retention cable after sliding the lamp housing through the frame opening.

* * * * *